US005887601A

United States Patent [19]

King

[11] Patent Number: 5,887,601

[45] Date of Patent: Mar. 30, 1999

[54] TOOTHBRUSH

[76] Inventor: James P. King, 9 River Trail Dr., Bay City, Mich. 48706

[21] Appl. No.: 13,018

[22] Filed: Jan. 26, 1998

[51] Int. Cl.[6] ..... A46B 11/00

[52] U.S. Cl. ..... 132/311; 15/167.1

[58] Field of Search ..... 132/308, 311; 15/167.1

[56] References Cited

U.S. PATENT DOCUMENTS

| | | | |
|---|---|---|---|
| 530,153 | 12/1894 | Zucker | 132/311 |
| 1,420,581 | 6/1922 | Schoneman | 132/311 |
| 1,645,965 | 10/1927 | Neumerkel | 15/167.1 |
| 2,168,689 | 8/1939 | Smith et al. | 132/311 |
| 2,491,207 | 12/1949 | Preble, Jr. et al. | 132/311 |
| 2,620,500 | 12/1952 | Ridner, Sr. . | |
| 2,634,207 | 4/1953 | Hausner | 132/308 |
| 2,657,412 | 11/1953 | Carlson . | |
| 2,701,381 | 2/1955 | Lodewick et al. | 15/167.1 |
| 2,762,074 | 9/1956 | Danchig . | |
| 2,962,032 | 11/1960 | Reuter . | |
| 3,755,848 | 9/1973 | Mutrie | 132/311 |
| 4,152,804 | 5/1979 | Morris . | |
| 4,344,535 | 8/1982 | Cagnazzi | 132/304 |
| 4,503,871 | 3/1985 | Mendenhall | 132/311 |
| 4,530,369 | 7/1985 | Adams . | |
| 4,866,809 | 9/1989 | Pelletier | 132/311 |
| 5,572,762 | 11/1996 | Scheiner . | |
| 5,622,195 | 4/1997 | Lee . | |

*Primary Examiner*—Todd E. Manahan
*Attorney, Agent, or Firm*—Robert L. McKellar

[57] ABSTRACT

A two element toothbrush wherein the two elements are capable of being temporarily joined together to provide a standard sized toothbrush, but which are capable of being disassembled from the toothbrush configuration and re-assembled to provide storage capability for the toothbrush. One element of the toothbrush provides a covered storage area for retainer rings which are frequently used by those wearing dental retaining devices.

1 Claim, 3 Drawing Sheets

TOOTHBRUSH

The invention disclosed and claimed herein deals with a two element toothbrush wherein the two elements are capable of being temporarily joined together to provide a standard sized toothbrush, but which are capable of being disassembled from the toothbrush configuration and re-assembled to provide storage capability for the toothbrush. Further, one element of the toothbrush provides a covered storage area for rubber rings which are frequently used by those wearing dental devices.

The device disclosed herein is particularly useful for those who wear devices and have a need to carry a ready supply of the rubber rings. This device allows for a sanitary means of carrying and storing such rubber rings.

BACKGROUND OF THE INVENTION

This invention deals with a toothbrush which is comprised of two elements which are capable of being easily assembled, disassembled, re-assembled, and which has a storage capability not only for the brushing head of the toothbrush, but also for any supplies needed for those wearing dental devices.

Toothbrushes and their storage capabilities have been disclosed previously. For example, U.S. Pat. No. 2,620,500, which issued Dec. 9, 1952 to Ridner, Sr. deals with a toothbrush which is used in combination with a case. The case is configured to fit over the handle of the toothbrush and one end of the case is configured to fit over the bristles of the brush itself. The case is otherwise hollow, and has a removable cap at each end.

There is a unique storage capability with regard to the folding toothbrush disclosed in Carlson, U.S. Pat. No. 2,657,412, which issued Nov. 3, 1953. A hollow storage case is provided which has a lid which opens away from the case, and a hinged brush head which is capable of swinging into the opened case. Thereafter, the lid is snapped into place to provide storage for the toothbrush, while providing a smaller, storageable unit.

The U.S. Pat. No. 2,762,074, which issued on Sep. 11, 1956 to Danchig deals with a toothbrush having twin heads. A receptacle is proved which allows for the storage of the toothbrush.

U.S. Pat. No. 2,962,032 which issued to Reuter on Nov. 29, 1960 deals with a three component toothbrush which has a storage case, but which also has a hollow handle which allows for the storage of dentifrice. The hollow storage tube which houses the tube of dentifrice also serves as a handle for the toothbrush once the dentifrice module is removed.

U.S. Pat. No. 4,152,804, which issued May 8, 1979 to Morris deals with a toothbrush which is disposable. It has two elements which are comprised of a brushing member and a second element which consists of a hollow handle in which the first component is housed while not in used.

U.S. Pat. No. 4,530,369, which issued on Jul. 23, 1985 to Adams deals with a fountain toothbrush.

U.S. Pat. No. 5,572,762, which issued Nov. 12, 1996 to Scheiner deals with a toothbrush having a hollow handle to provide an enclosure for a sound generating system. There is no storage capability for the toothbrush, however.

Finally, there is a travelling toothbrush disclosed in U.S. Pat. No. 5,622,195 which issued on Apr. 22, 1997 to Lee. The toothbrush has three elements and is designed such that the brush cover has the configuration of a fountain pen such that it can be carried like a fountain pen. Further, the handle of the brush has depressions in which there can be stored a razor head and dentifrice, and in which there is another tubular cover that slips over the storage area of the handle. This toothbrush does not have the capability of being stored in a convenient smaller package for travel.

THE INVENTION

The invention herein deals with an a toothbrush that is easily manufactured, is inexpensive to manufacture, and is markedly useful for those requiring the constant maintenance of oral dental devices.

Such a device is a toothbrush comprising two elements (A) and (B). The first element (A) comprises a brushing head (2) having flexible bristles fixedly attached to it. There is a shaft and the shaft has a near end and a distal end. The shaft carries the brushing head at the near end. There is also a handle which is unitarily joined with the distal end of the shaft and the handle has a compartment in it. The handle has at least one opening through it for accessibility to the compartment and the opening has an operable cover on it. The cover has an upper surface and surmounted on the upper surface is a series of essentially parallel rounded ribs, which are located transverse to the longitudinal axis of the cover.

Element (B), the second element is a removable hollow, elongated storage housing (15) which doubles as an extension unit for (A). The unit has one open end, one closed end, and at least one sidewall. The housing has a hollow raised rib transverse of the longitudinal axis of the housing and through the sidewall near the open end thereof.

The hollow raised rib is constructed such that any one of the parallel rounded ribs of the cover are insertable therein to provide a temporary connection between components (A) and (B) when (A) and (B) are attached to each other.

DETAILED DESCRIPTION OF THE INVENTION

Figure 1:
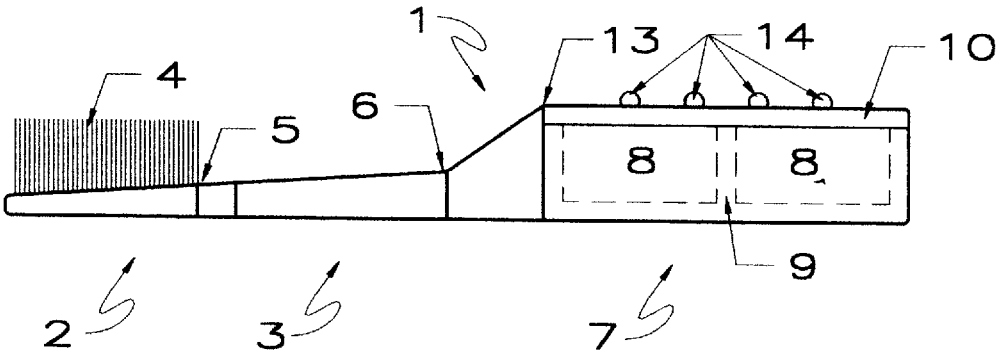
FIG. 1 is a full side view of one element of the device which is the toothbrush element showing the compartments in phantom.

Now, turning to FIG. 1, there is shown a full side view of one element of the device, which is the toothbrush element 1.

Shown in the Figure are the brushing head 2, unitarily joined with a shaft 3. The brushing head 2 has bristles 4 fixedly surmounted on it. The bristles 4 can be the customary dental bristles used in standard toothbrushes. The shaft 3 has a near end 5 and a distal end 6, and the brushing head 2 is joined with the shaft 3 at the near end 5 of the shaft 3.

There is a handle 7, joined unitarily with the shaft 3, at the distal end 6 of the shaft 3, such that the brushing head 2, the shaft 3, and the handle 7, all come together to form the toothbrush 1.

The handle 7 has a storage compartment 8 located within it and the storage compartment 8 is utilized for the sanitary storage for rubber rings for dental devices. The compartment 8 can be manufactured in more than one segment. The storage compartment 8 is shown in phantom in FIG. 1, and in a top view in FIG. 3. In the device shown in FIG. 1, it should be noted that the storage compartment 8 is shown in two separate compartments whose common wall 9 form an interior wall for the handle 7. This common wall 9 is not critical and can be used or not used if desired. The inside wall 9 lends support and stability to the handle 7.

Figure 3:
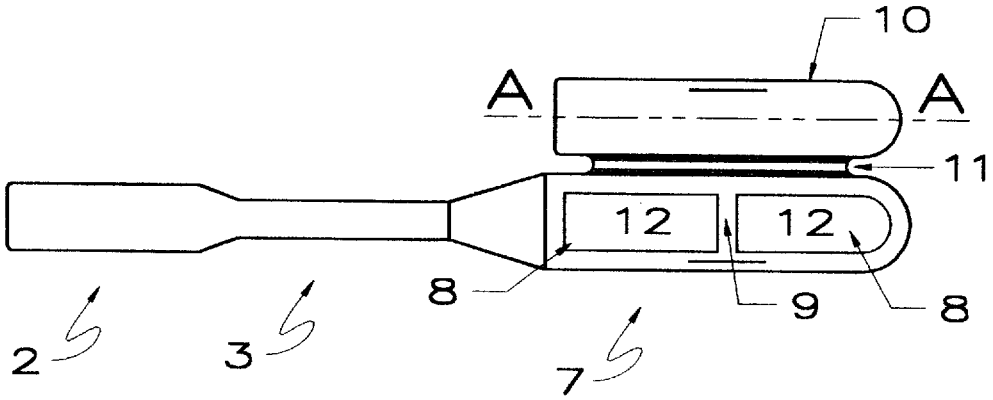
FIG. 3 is a full top view of FIG. 1, showing one embodiment of a lid for the compartment which is shown in an open position.

Shown in FIG. 1 in a closed position, and in FIG. 3 in an open position to expose the openings 12 into the individual compartments 8, is cover or lid 10, for the compartment 8. Shown is one embodiment of the invention in that a hinged lid is shown, which is hinged on the side edge by hinge 11 (FIG. 3). It is contemplated within the scope of this invention that the cover or lid 10 can be hinged on either side, front, or back, or the cover or lid 10 can be a snap in type of lid, or, can be a slidable lid, as the form of closure for the lid 10 is not critical, as long as the lid 10 prevents dust and debris from entering the compartment 8. Its only functions are to hold the material stored in the compartments 8 securely, and to keep the materials stored therein as sanitary as is possible.

Surmounted on the upper surface 13 of the lid 10, are a series of essentially parallel rounded ribs 14, which are located transverse to the longitudinal axis A—A of the lid (shown in FIG. 3). The exact number of these ribs 14 is not critical and their intended function will be described infra.

Figure 2:
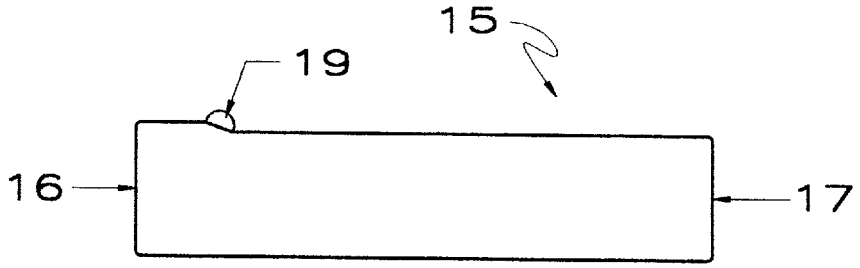
FIG. 2 is a full side view of the second element of the device which is the storage and extension unit of the device
Figure 4:
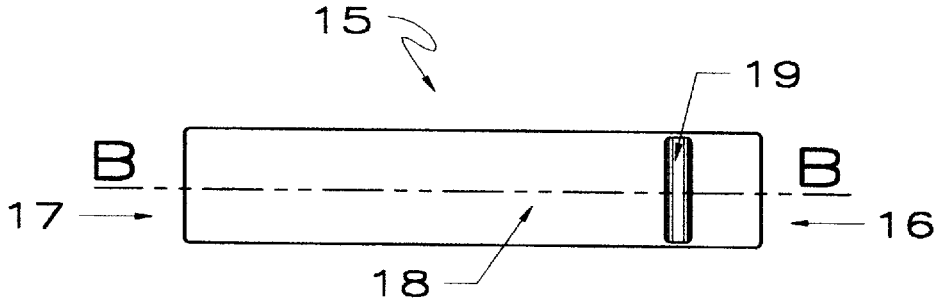
FIG. 4 is a full top view of the second element showing the hollow raised rib transversely positioned.
Figure 5:
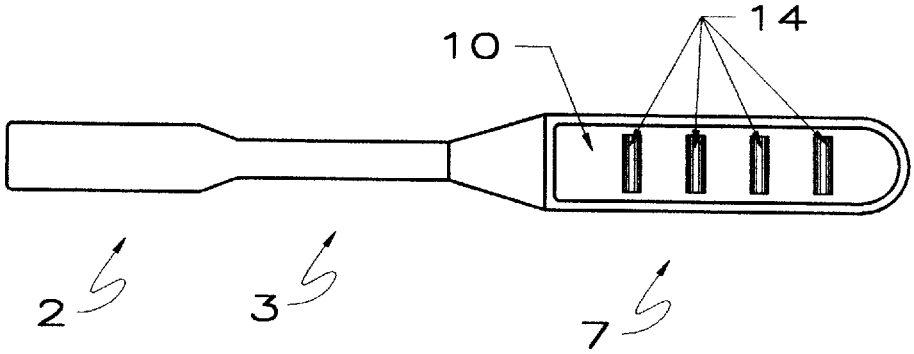
FIG. 5 is a full top view of the first element showing the series of essentially parallel rounded ribs, which are located transverse to the longitudinal axis of the cover.
Figure 6:
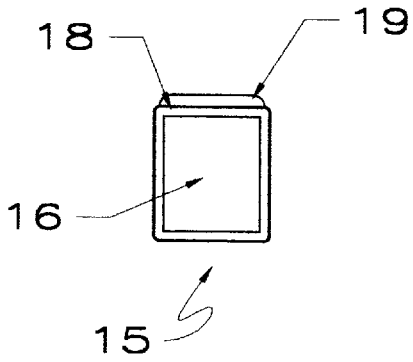
FIG. 6 is a view of this element showing the invention.

Turning now to the second element of this invention (B), there is shown one such element 15 in FIGS. 2, 4, and 6, which is a removable hollow elongated storage housing and extension unit for the first element (A).

The second element 15 has an open end 16 (FIG. 6), a closed end 17, and at least one side wall 18. It should be noted that if the handle 7 and the second element (B) are constructed in a tubular configuration, then there would only be one sidewall 18. For purposes of illustration, there is shown a rectangular configuration (FIG. 6), and the side wall 18 referred-to herein is the top wall of the rectangular configuration.

The open end 16 of the second element 15 is sized to accommodate the brushing head 2 such that when the toothbrush 1 is not used, and is stored, the brushing head 2 and the shaft 3 are inserted into the second element 15 for storage. Thus, the second element (B) should be sized such that the element (A) fits snugly into the interior of element (B) such that it requires a slight tug to separate the two elements for use.

The sidewall 18 has at least one hollow raised rib 19 located transverse of the longitudinal axis B—B of the housing 15, as shown in FIG. 4, it being noted that only one such hollow raised rib 19 is shown herein.

One function of the hollow raised rib 19 is to temporarily help join together the elements (A) and (B) to form a full size toothbrush, while an additional function of the element (B) is to form an extension of the element (A) to allow easier handling of the toothbrush 1. The joining together of the two elements is provided by slipping the open end 16 of the second element (B) over the end 20 of the handle 7 until the hollow raised rib 19 moves over at least one of the hollow parallel rounded ribs 14. With multiple ribs 14, one can adjust the second element (B) on the handle 7 of the first element (A) and, adjust the length of the entire toothbrush 1 and thus, normally one to four such ribs 14 is all that is required.

The toothbrush 1, except for the bristles 4 is manufactured from plastics. The plastics can either be thermoplastic or thermoset plastics, depending on the weight desired, the flexibility needed, and the cost thereof.

What is claimed is:

1. A toothbrush comprising two elements:

(A) a first of said elements comprising:

(i) a brushing head having flexible bristles fixedly attached thereto;

(ii) a shaft, said shaft having a near end and a distal end, said shaft carrying the brushing head at the near end thereof and, (iii) a handle, unitarily joined with the distal end of the shaft, said handle having a compartment therein, said handle having at least one opening through it for accessibility to the compartment, said opening having an operable cover thereon, said cover having a longitudinal axis and an upper surface and surmounted on said upper surface a series of essentially parallel rounded ribs, which are located transverse to the longitudinal axis of the cover; and, (B) a second of said elements which is a removable hollow, elongated storage housing and extension unit for said first element, and storage housing and extension unit having one open end, one closed end, and at least one sidewall; said storage housing and extension unit having at least one hollow raised rib transverse of the longitudinal axis of the housing and through at least one sidewall near the open end thereof; said hollow raised rib constructed such that any one of the parallel rounded ribs of the cover are insertable therein to provide a temporary connection between said first and second elements when said elements are attached to each other.

* * * * *

UNITED STATES PATENT OFFICE

CERTIFICATE OF CORRECTION

Patent No. 3,887,601 Dated June 3, 1975

Inventor(s) Bernard Kanner, Bela Prokai and Walter R. Rosemund

It is certified that error appears in the above-identified patent and that said Letters Patent are hereby corrected as shown below:

Column 3, line 48, for "polyesterbased" read -- polyester-based --. Column 4, line 44, for "sysmbol" read -- symbol --. Column 5, line 31, for "132,360" read -- 132,534 --. Column 7, line 20, after "ethylcarbamyl" delete "(". Column 9, line 16, the partially printed word before "monofunctional" should read -- and --. Column 11, line 41, for "REactant" read -- Reactant --. Column 12, line 50, for "hydrogensubstituted" read -- hydrogen-substituted --. Column 13, line 12, for "THe" read -- The --; line 32, for "sufficiently" read -- sufficient --. Column 18, line 30, for "azetrope" read -- azeotrope --; line 57, after "10" insert -- weight --. Column 21, line 41, for "foamproducing" read -- foam-producing --; line 59, for "THe" read -- The --. Column 22, line 17, after "1953" insert -- ) --. Column 24, line 25, for "Si-NCO" read -- ≡Si-NCO --. Column 25, line 8, for "-1,3butanediamine" read -- -1,3-butanediamine; line 62, for "THe" read -- The --. Column 26, line 17, for "flourinated" read -- fluorinated --; line 48, that portion of the formula reading "[Cl" should read -- [(Cl --; line 55, for "(2,3-dichloropropyl)" read -- (2,3-dibromopropyl) --; line 63, for "tethylene" read -- ethylene --. Column 29, line 14, that portion of the formula reading "$CY=CH_2$" should read -- $CH=CH_2$ --; line 15, that portion of the formula reading "$C_5H_5$" should read -- $C_6H_5$ --; line 26, delete the second occurrence of "the". Column 30, line 26, delete "units". Column 31, line 60, delete "units". Column 33, in the first line under the formula shown at the top of this column, delete "units"; line 46, delete "units". Column 44, line 18, for "organosilicon" read -- organosilicone --.

Signed and Sealed this

*seventeenth* Day of *February 1976*

[SEAL]

*Attest:*

RUTH C. MASON
*Attesting Officer*

C. MARSHALL DANN
*Commissioner of Patents and Trademarks*